US005429719A

United States Patent [19]

Rhyne

[11] Patent Number: 5,429,719

[45] Date of Patent: Jul. 4, 1995

[54] SELF-ALIGNING DRYER FABRIC LOADING HARNESS

[75] Inventor: Myron T. Rhyne, Youngsville, N.C.

[73] Assignee: Huyck Licensco, Inc., Wilmington, Del.

[21] Appl. No.: 118,977

[22] Filed: Sep. 9, 1993

Related U.S. Application Data

[62] Division of Ser. No. 914,874, Jul. 16, 1992, Pat. No. 5,306,393.

[51] Int. Cl.[6] ..... D21F 1/24

[52] U.S. Cl. ..... 162/200; 162/273; 162/274; 162/358.1; 34/120; 226/93

[58] Field of Search ..... 34/120; 162/200, 273, 162/274, 358.1; 139/384 B, 383 A; 428/380; 226/93, 91

[56] References Cited

U.S. PATENT DOCUMENTS

| | | | |
|---|---|---|---|
| 2,668,337 | 2/1954 | Lodge | 24/85 |
| 3,508,342 | 4/1970 | Levtchouk et al. | 34/120 |
| 4,127,441 | 11/1978 | Stegelitz | 162/200 |
| 4,309,830 | 1/1982 | Vits | 34/120 |
| 4,467,950 | 8/1984 | Karlsson et al. | 226/91 |
| 4,755,260 | 7/1988 | Sakuma | 162/199 |
| 4,758,309 | 7/1988 | Johansson | 162/273 |
| 4,923,567 | 5/1990 | Liedes et al. | 162/193 |
| 4,931,141 | 6/1990 | Shafranski | 162/255 |

*Primary Examiner*—W. Gary Jones
*Assistant Examiner*—Dean T. Nguyen
*Attorney, Agent, or Firm*—Lorusso & Loud

[57] ABSTRACT

A self-aligning fabric loading harness for installing a fabric body having a leading edge and a plurality of spaced empty grommets disposed proximate to the leading edge onto a papermaking machine, the harness including a line receiving device, having an aperture, spaced from the leading edge; and a line, having first and second ends, being successively and slidably laced through the line receiving device aperture and the aperture of each empty grommet, the first and second ends of the line being separately secured, and a method for installing a fabric body using that harness. The harness and method being particularly useful for installing dryer fabrics onto paper machines.

12 Claims, 1 Drawing Sheet

SELF-ALIGNING DRYER FABRIC LOADING HARNESS

This application is a divisional of application Ser. No. 07/914,874, filed Jul. 16, 1992, now U.S. Pat. No. 5,306,393 issued Apr. 26, 1994.

FIELD OF INVENTION

This invention relates to a device and method for installing a seamed fabric, and particularly dryer fabrics, onto paper machines and more particularly to a harness which pulls a fabric body onto the machine and a method for making same. The harness and method may also be used for installing other seamed fabrics such as a seamed press felt, onto a papermaking machine.

BACKGROUND OF THE INVENTION

In the manufacture of paper, the paper web is passed through a dryer section, after the forming and press sections, to further remove entrained water and to correspondingly increase the density of paper fibers. In the dryer section, the wet paper web is passed about and held in contact with upper and lower arrays of heated cylinders to remove water in the web. The paper web is held in thermal contact with the heated cylinder by a dryer felt or dryer fabric, generally called a dryer fabric, which is in the form of an endless belt. Dryer fabrics in modern papermaking machines may have a width of from 5 to over 32 feet, a length of from 40 to over 400 feet and weigh approximately 100 to over 3,000 pounds. These fabrics wear out and may require replacement after only 8 months of continuous operation. At the present time, replacement of dryer fabrics now involves taking the machine out of service, removing the worn fabric, setting up to install a new fabric and installing the new fabric. Installation of the new dryer fabric includes pulling the fabric body onto a machine and joining the fabric ends to form an endless belt.

A number of factors are considered when installing a dryer fabric. One factor is the time the paper machine is out of service to replace the fabric (i.e., machine downtime) including the associated cost. Another factor is the manpower required to replace a dryer fabric which can affect mill costs and operation in a number of different ways. Fabric replacement usually involves working on an overtime basis and affects (e.g., delays) other maintenance activities. It is also critical that the dryer fabric be properly installed otherwise below grade paper can result and/or additional costs can be incurred.

One important aspect of loading a fabric body onto a paper machine is that there be uniform tension across the fabric. If uniform tension is not achieved and one section of the fabric pulls more than another, then the fabric can bubble or ridge across the fabric width. Bubbling or ridging is a problem where there are small clearances, such as between blow boxes and cans, in the run of the dryer fabric through an operating machine. For example, a ridged fabric may catch in these small clearance areas and damage the fabric and/or the machine's parts (e.g., a blow box). If the fabric or machine is damaged, then the machine must be shut down, the damaged parts repaired and the damaged fabric replaced.

Another aspect of loading a fabric body is preventing damage to the fabric body seam, generally referred to as seam burnout, when removing the standard leader from the fabric body. A fabric shipped to a papermill will generally have a removable standard leader attached to facilitate loading the fabric onto the paper machine. The standard leader includes a series of grommets proximate and in a line generally parallel on one edge and at its opposite edge, it is connected to a fabric body seam by means of a wire or monofilament cable. The standard leader is later removed by pulling the wire or cable out of the seam. In order to avoid or minimize the chance of damage to the seam during installation, weight and pressures must be off the seam before pulling the wire or cable out. If the seam undergoes minor damage a wire or cable is removed, the seam may be repaired in place. However, if the seam undergoes major damage, then the damaged fabric body must be removed from the machine and another fabric body installed in its place. The damaged fabric is returned to the factory to be re-seamed so it can be used again.

A further aspect of loading a dryer fabric is properly aligning the fabric body in the machine so the dryer fabric does not wear out prematurely. If the fabric is not properly aligned in the machine during installation the fabric could oscillate during operation and/or edge curling could result.

Damaging the fabric during installation can also result in unacceptable impressions or marks in the paper produced on the fabric. In sum, improper installation may result in additional machine downtime, a need for additional manpower to correct the nonconforming condition or install a new fabric, product losses, repairs to the machine and, possibly, a damaged fabric that will have to be replaced. There is, therefore, a need for a loading harness which can reduce machine downtime and manpower requirements while assuring proper installation of the dryer fabric.

Paper mills use a variety of methods and devices for pulling dryer fabrics onto a paper machine. One of the more common devices is a loading harness made of a single ring with a number of metal cables attached thereto for connection to the dryer fabric. These cables are typically clamped to the grommets in the dryer fabric leader. Even though this is one of the quicker methods for attaching a harness to a fabric for installation, it is still time consuming. The harness must be located, moved to the site where the fabric is to be loaded onto the machine, the fabric unrolled so the harness can be attached to the standard leader, the cables untangled and finally attached to the fabric body prior to the installation process. Also, because of its metal construction, the harness is heavy and awkward to move about a mill.

As explained above, in order to avoid or minimize the potential for damaging the fabric body and the machine during installation and operation, the harness should be attached to the fabric body so there is uniform tension across the body. For the above harness, this is accomplished by having individual cables between the ring and body of different fixed lengths. This type of harness cannot automatically align and configure itself for a given application due to the fixed length metal cables. Rather, the harness must be designed and constructed to work for the particular dryer fabric to be installed.

This type of harness is very expensive to make and, as such, is not shipped with each fabric. Notwithstanding the expense, it is also unlikely that such a harness would be shipped attached to a dryer fabric because of the potential for damage to the fabric during shipping.

Using this harness also has disadvantages when removing the standard leader. Because of the ring/metal cable harness' weight and design, it is difficult and awkward to take the weight off the seam to remove the leader. As such, seam burnout is of particular concern when using this type of harness.

Another type of loading harness used in the industry is constructed from an extra length of dryer fabric which is triangular in shape and typically 20–30 feet long. This fabric harness is attached to the dryer fabric and has a grommet at the triangle's apex, opposite the dryer fabric, to pull the dryer fabric onto the machine. This type of harness is not commonly used because it is not economical to weave extra lengths of dryer fabric to make such harnesses and there is not enough of a supply of waste fabric for its production.

Another device, disclosed in U.S. Pat. No. 4,758,309, includes a supplemental strip of material mounted to and along the longitudinal edges of a fabric belt. The strip is formed with spaced apertures along the length of the belt, which apertures are shaped so that they can be gripped by hand or by a special tool. Alternatively handle loops may be attached and spaced along the length of one or both longitudinal edges presumably to be gripped by hand. This device, however, cannot be used to install dryer fabrics onto a papermaking machine for a number of reasons.

The patented device is used to install press felts which are shipped and installed as endless belts. Papermaking machines are designed so that press felts may be installed over the press section rollers from the side (i.e., installed in a direction perpendicular to the direction of travel during operation). However, paper machines are not designed to install dryer fabrics in this direction (e.g., rollers are not cantilevered so fabric can be installed from side). Thus, a dryer fabric must be pulled onto the machine parallel to the direction the fabric travels during operation.

It is also not possible to install dryer fabrics onto a paper machine by hand. The machines are not designed for access to the dryer fabric side edges to pull the fabric onto and through the machine. Therefore, the side strips or loops of this patented device would not serve any purpose. It is also not practical to install dryer fabrics by hand. Press felts are short and usually weigh 400 pounds or less, whereas dryer fabrics are typically longer and heavier. Thus as a consequence of machine design, the dryer fabric must be installed by pulling on one of the ends of the fabric body.

Moreover, use of special tools involves locating the tool at the mill, bringing it to the installation site, setting the tool up, unpacking or unrolling the fabric belt and finally interconnecting the tool in an unspecified fashion to the supplemental strip's spaced apertures prior to installation.

Therefore, it is an object of the present invention to eliminate the need to have harnesses or special tools at a paper mill for dryer fabric installation.

It is a further object of the present invention to simplify the installation process for dryer fabrics at paper mills.

It is yet another object of the present invention to provide a harness which is self-aligning to ensure uniform tension is maintained across the width of the dryer fabric.

Another object of the present invention is to provide a harness which can be attached to the fabric body before the fabric body is shipped to a paper mill.

It is yet another object of the present invention to reduce the time and costs associated with installing dryer fabrics.

It is yet a further object of the present invention to provide a harness which can be used to install seamed fabrics or seamed belts, other than dryer fabrics, onto a paper machine.

SUMMARY OF THE INVENTION

This invention is a truly simple and effective harness for pulling a fabric body onto a paper machine. The harness is produced by spacing a line receiving device from the leading edge of the fabric body, successively and slidably lacing a line through the line receiving device and grommets near the fabric body leading edge and separately securing the ends of the line. Such a harness can automatically adjust the length of line between each grommet and the line receiving device so that the harness can align itself to the direction of pull and ensure uniform tension across the dryer fabric.

This invention features a line receiving device having an aperture, and a line having first and second ends, to pull a fabric body having a plurality of spaced empty grommets disposed proximate the fabric body leading edge. The line receiving device is spaced from the leading edge and the line is successively and slidably laced through the line receiving device and each of the empty grommets before both ends of the line are separately secured. In a preferred embodiment, the line receiving device may be spaced from the leading edge on a fabric body centerline perpendicular to the leading edge, the ends of the line may be secured to separate grommets or to the line receiving device, one end of the line may be secured to a grommet near a fabric body side edge, the other end of the line may be secured to a grommet near the fabric body centerline and the line may be alternately laced through the aperture of an empty grommet located on one side of the fabric body centerline through the line receiving device aperture to the aperture of an empty grommet on the other side of the body centerline. This invention includes a method for making a harness as described above.

This invention also features a method for installing a fabric in a paper machine using the self-aligning loading harness. In addition to incorporating the steps for making such a loading harness, the method for installing includes securing a pull line to the line receiving device and pulling the pull line in a direction so the fabric is properly installed in the paper machine.

DESCRIPTION OF THE PREFERRED EMBODIMENT

Figure 1:
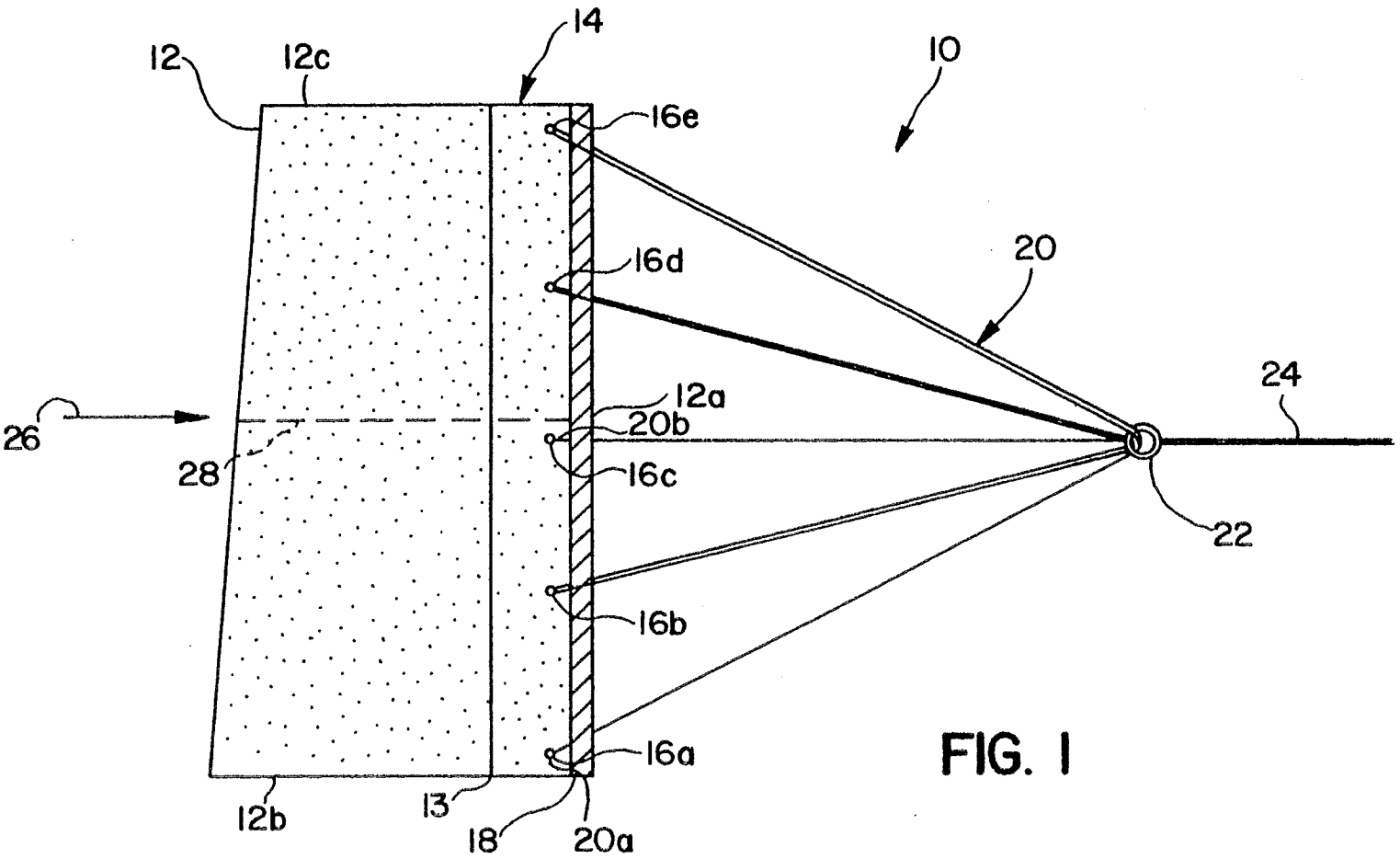
FIG. 1 is a plan view of a self-aligning dryer fabric loading harness according to the present invention when affixed to a typical dryer fabric body.

Included in FIG. 1 is a dryer fabric body as is known to the art. While a dryer fabric is shown it should be understood that the harness of the present invention can be used to install other seamed fabrics and belts, such as a seamed press felt, on a paper machine. A fabric body 12 shipped to a paper mill has a removable standard leader 14 which includes steel bar 18. The standard leader 14 is removably attached to body seam 13 of fabric body 12 by means of a wire or monofilament cable (not shown). Fabric body 12 also has a leading edge 12*a*; side edges 12*b,c* perpendicular to leading edge 12*a* and a fabric body centerline 28, parallel to the side edges 12*b,c* and perpendicular to the leading edge 12*a*. Disposed on standard leader 14 are a plurality of grommets 16*a–e*, having empty grommet apertures. Grommets 16*a–e* are proximate and in a line parallel to leading edge 12*a*. While FIG. 1 illustrates five grommets 16*a*–16*e*, it should be recognized that more or less grommets may be used and there may be an even or odd number of grommets. The grommets may be brass or other materials well known in the art for such a use.

A self-aligning dryer fabric loading harness 10 according to the present invention includes rope 20, having ends 20*a* and 20*b*, and ring 22. Ring 22 is spaced from leading edge 12*a* and on fabric body centerline 28. Typically the center of ring 22 is spaced 30–40 feet from leading edge 12*a*. The materials used for ring 22 include steel or other material known in the art for such a use. While ring 22 is illustrated as being circular, it should be recognized that ring 22 can be any shape or it may be any line receiving device which can slidably receive a line and which will permit rope 20 to slide so that loading harness 10 can be self-aligning.

Rope 20 can be a rope made of any material, such as nylon, polyester, or polyethylene, which has sufficient strength to pull the fabric body onto the machine. The rope should also be a material that is not likely to damage the fabric when the harness is connected to and shipped with the fabric body and whose weight minimizes concerns of seam burnout. It should be recognized that products in a form other than a rope can be used provided the product chosen is slidable through the grommets and the ring/line receiving device.

Referring to FIG. 1, to form the harness 10 of the present invention, end 20*a* of rope 20 is secured to grommet 16*a*, which grommet is proximate fabric body side edge 12*b*. End 20*b* of rope 20 is secured to grommet 16*c*, which grommet is proximate fabric body centerline 28. After securing end 20*a* to grommet 16*a*, end 20*b* is successively passed through the aperture of ring 22 and grommets 16*b,d,e* as follows: first through ring 22, then through grommet 16*e*, back through ring 22, then through grommet 16*b*, back through ring 22, then through grommet 16*d*, back through ring 22 and then to grommet 16*c* and secured. It should be recognized that the foregoing describes rope 20 as it is alternatively laced from grommets on one side of body centerline 28 to grommets on the other side of body centerline 28 through ring 22. When loading harness 10 is attached to fabric body 12 in this way, the harness will self-align to ensure uniform tension across the width of fabric body 12. Self-alignment is achieved because rope 20, between ends 20*a,b*, can slip in ring 22 and grommets 16*b,d,e* changing the length of line between the ring and each of the grommets which equalizes tension.

In reviewing the above description, it should be recognized that either end or both ends can be secured last. Also, the ends can be secured to the grommets or the ring. One skilled in the art will connect the ring to the grommets to produce the harness of the present invention in any number of ways as long as the final configuration permits the line between the fixed ends to slide in the intervening grommets and ring.

Installation of fabric body 12 onto a paper machine is accomplished by securing pull rope 24 to ring 22 of loading harness 10. The loading harness 10 is preferably attached to the fabric body at the factory, however, it can be attached at the mill. When loading harness 10 is attached to fabric body 12 at the factory, the assembled body and harness is packaged and shipped to the paper mill. When fabric body 12 is shipped in this manner, pull rope 24 is secured to ring 22 and fabric body 12 is pulled directly onto the machine from the opened shipping box or shipping container (not shown) in direction of arrow 26. Once used, loading harness 10 is removed from fabric body 12 and discarded. Thus there is no need for special tools, other harnesses or installation devices to be maintained at the paper mill or to be moved about the mill to the installation site.

Eliminating the requirement for special harnesses or tools would simplify the installation process because there will be no need to locate a harness or tool required for installation or have the harness or tool made available at the installation location. It will also be less costly because additional harnesses or special tools will not have to be purchased, and resources (e.g., manpower) will not have to be expended to make the harness or tool available at the installation location. Simplifying the installation process itself saves money because the paper machine will be out of service for a shorter time period for maintenance. There will even be cost savings if the harness is installed at a mill because of the lower cost for the harness materials, because of the simpler installation process for such a harness and since the harness materials are items which do not need to be specially purchased like the prior art metal ring/metal cable harness.

While a preferred embodiment of the invention has been described using specific terms, such description is for illustrative purposes only, and it is to be understood that changes and variations may be made without departing from the spirit or scope of the following claims.

What is claimed is:

1. A self-aligning fabric loading harness for installing and in combination with a fabric body, the fabric body having a leading edge and two side edges perpendicular to the leading edge and parallel to each other and a plurality of spaced empty grommets having apertures proximate the leading edge, said loading harness comprising:

a line receiving device, having an aperture, spaced from the leading edge; and a line, having first and second ends, said line being successively and slidably laced through the line receiving device aperture and through the aperture of each empty grommet, the first and second ends of said line being separately secured so said line receiving device is interconnected to the fabric body.

2. The self-aligning fabric loading harness of claim 1, in which said line receiving device is spaced from the leading edge on a fabric body centerline perpendicular to the leading edge.

3. The self-aligning fabric loading harness of claim 2, in which said line is alternatively and slidably laced through the aperture of an empty grommet located on one side of a centerline of the fabric body, through the line receiving device aperture and to the aperture of an empty grommet located on the other side of the fabric body centerline.

4. The self-aligning fabric loading harness of claim 1, wherein the first and second ends of said line are secured to separate grommets of the plurality of spaced empty grommets.

5. The self-aligning fabric loading harness of claim 4, in which one end of said line is secured to a grommet proximate a side edge of the fabric body.

6. The self-aligning fabric loading harness of claim 5, in which an end of said line, other than the end secured to a grommet proximate a side edge of the fabric body, is secured to a grommet proximate a centerline of the fabric body perpendicular to the leading edge.

7. The self-aligning fabric loading harness of claim 1, wherein the first and second ends of said line are separately secured to said line receiving device and secured so the line between the first and second ends remains slidably laced through the line receiving device aperture.

8. The self-aligning fabric loading harness of claim 1, wherein said line receiving device is a metal ring.

9. The self-aligning fabric loading harness of claim 1, wherein said line is a rope.

10. The self-aligning fabric loading harness of claim 1, wherein each portion of said line slidably laced through the line receiving device aperture and through the aperture of each grommet is laced so each portion of said line automatically readjusts in response to a pulling force applied to said line receiving device.

11. A self-aligning paper machine dryer fabric loading harness for installing and in combination with a fabric body, the fabric body having a leading edge and first and second side edges, the first and second side edges being perpendicular to the leading edge and parallel to each other, and five spaced grommets having apertures disposed in a line parallel to and proximate the leading edge, said loading harness comprising:

a line receiving device, having an aperture, being spaced from the leading edge on a fabric body centerline perpendicular to the leading edge;

a line having first and second ends;

wherein the first end of said line is secured to a first grommet proximate the first side edge of the fabric body; and wherein the second end of said line is slidably laced through the line receiving device aperture and then through the aperture of a second grommet proximate the second side edge, the second end then is slidably laced back through the line receiving device aperture and then through the aperture of a third grommet, the third grommet being proximate the first grommet and closer to the fabric body centerline than the first grommet, the second end then is slidably laced back through the line receiving device aperture and then through the aperture of a fourth grommet, the fourth grommet being proximate the second grommet and closer to the fabric body centerline than the second grommet, the second end then is slidably laced back through the line receiving device aperture and then to a fifth grommet proximate the fabric body centerline, the second end then is secured to the fifth grommet.

12. The self-aligning paper machine fabric loading harness of claim 11, wherein each portion of said line slidably laced through the line receiving device aperture and through the aperture of each grommet is laced so each portion of said line automatically readjusts in response to a pulling force applied to said line receiving device.

* * * * *